US008240000B2

(12) United States Patent
Oh et al.

(10) Patent No.: US 8,240,000 B2
(45) Date of Patent: Aug. 14, 2012

(54) BYPASS TYPE CLEANING APPARATUS

(75) Inventors: Jang-keun Oh, Gwangju (KR); Min-ha Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1132 days.

(21) Appl. No.: 12/149,296

(22) Filed: Apr. 30, 2008

(65) Prior Publication Data

US 2009/0193611 A1 Aug. 6, 2009

(30) Foreign Application Priority Data

Jan. 31, 2008 (KR) ..... 10-2008-0010277

(51) Int. Cl.
*A47L 9/10* (2006.01)

(52) U.S. Cl. ..... 15/347; 15/412

(58) Field of Classification Search ..... 15/347–351, 15/412; *A47L 9/10*
See application file for complete search history.

(56) References Cited

U.S. PATENT DOCUMENTS 4,654,916 A 4/1987 Postonen et al.
2011/0284028 A1* 11/2011 Castronovo ..... 134/10

FOREIGN PATENT DOCUMENTS

JP 05-184496 7/1993
WO 00/59358 10/2000
WO 02/28257 4/2002

* cited by examiner

*Primary Examiner* — David Redding
(74) *Attorney, Agent, or Firm* — Blank Rome LLP

(57) ABSTRACT

A bypass type cleaning apparatus includes a suction nozzle; an air suction unit being in fluid communication with the suction nozzle via an entering passage; and at least two contaminant collecting receptacles being in fluid communication with at least two exits formed at the air suction unit, respectively.

16 Claims, 9 Drawing Sheets

BYPASS TYPE CLEANING APPARATUS

CROSS-REFERENCE TO RELATED APPLICATIONS

This application claims the benefit under 35 U.S.C. §119 (a) of Korean Patent Application No. 2008-10277 filed Jan. 31, 2008 in the Korean Intellectual Property Office, the disclosure of which is incorporated herein by reference in its entirety.

BACKGROUND OF THE INVENTION

1. Field of the Invention

The present invention relates to a cleaning apparatus. More particularly, the present invention relates to a bypass type cleaning apparatus having a bypass passage structure in that air does not pass through a motor but around the motor.

2. Description of the Related Art

Generally, vacuum cleaners use a suction motor to generate a suction force for drawing in air with dust or contaminants (hereinafter, referred to as contaminants). The suction motor of the vacuum cleaner is disposed downstream from a contaminant collecting apparatus that separates contaminants from the drawn-in air and collects the separated contaminants. Therefore, the contaminants drawn in by the suction force of the suction motor are separated from air when passing through the contaminant collecting apparatus. Clean air having contaminants removed passes through the suction motor, and then, is discharged to outside of the vacuum cleaner.

However, since the conventional vacuum cleaner is configured so that the suction motor is disposed downstream from the contaminant collecting apparatus, the suction force of the suction motor is not directly applied to the contaminants on a surface to be cleaned. That is, the suction force of the suction motor operates on the surface to be cleaned via the contaminant collecting apparatus such that the suction force operating on the surface to be cleaned is reduced. As a result, a strong suction force is required in order to efficiently draw in contaminants. So a high capacity suction motor is used to generate the strong suction force. The high capacity suction motor, however, consumes a lot of electrical power. Therefore, when a cleaning apparatus, such as a robot cleaner and a stick type cleaning apparatus uses a battery as an electrical power source of the suction motor, a usable time of the apparatus is shortened.

On the other hand, when a low capacity suction motor is used to reduce the electrical power consumption, since the suction force of the suction motor is not directly applied to the surface to be cleaned, a contaminant suction efficiency with which the cleaning apparatus draws in contaminants inside thereof may be reduced.

Therefore, development of a cleaning apparatus having lower electrical power consumption and high contaminants suction efficiency is needed.

SUMMARY OF THE INVENTION

The present invention has been developed in order to overcome the above drawbacks and other problems associated with the conventional arrangement. An aspect of the present invention is to provide a bypass type cleaning apparatus having lower electrical power consumption and high contaminants suction efficiency.

The above aspect and/or other features of the present invention can substantially be achieved by providing a bypass type cleaning apparatus, which includes a suction nozzle; an air suction unit being in fluid communication with the suction nozzle via an entering passage; and at least two contaminant collecting receptacles being in fluid communication with at least two exits formed at the air suction unit, respectively.

The entering passage may be disposed at a center of the air suction unit.

The at least two contaminant collecting receptacles may be arranged to be symmetric each other at both sides of the air suction unit The air suction unit may include a housing connected with the entering passage, and having the at least two exits; an impeller disposed inside the housing; and an impeller motor disposed outside the housing, and causing the impeller to rotate.

The suction nozzle may include a rotating brush rotatably disposed at a contaminant suction port thereof.

The rotating brush may be disposed to rotate by a brush motor disposed underneath one of the least two contaminant collecting receptacles.

Each of the at least two contaminant collecting receptacles may include a filter.

The impeller may include a rotating plate connected to a rotating shaft of the impeller motor; and a plurality of blades disposed on the rotating plate.

The plurality of blades may comprise 4 to 6 blades.

Each of the plurality of blades may be formed in a shape selected from a group of an airfoil, flipped end shape, and a circular tip shape.

According to another aspect of the present invention, a bypass type cleaning apparatus may include: a suction nozzle; an air suction unit disposed at one side of the suction nozzle, and being in fluid communication with the suction nozzle via an entering passage; and first and second contaminant collecting receptacles disposed at both sides of the air suction unit, and being in fluid communication with the air suction unit.

The air suction unit may include a housing having an entrance connected with the entering passage, and first and second exits connected with each of the first and second contaminant collecting receptacles; an impeller disposed inside the housing; and an impeller motor disposed outside the housing, and causing the impeller to rotate.

The entrance of the housing may be formed at a center of a front surface of the housing.

The first and second exits of the housing may be formed at both side surfaces of the housing.

The suction nozzle may include a rotating brush rotatably disposed at a contaminant suction port thereof. The rotating brush is configured to rotate by a brush motor disposed underneath one of the first and second contaminant collecting receptacles.

According to another aspect of the present invention, a robot cleaner may include a robot body running autonomously and performing a cleaning task; and a bypass type cleaning apparatus disposed at the robot body, the bypass type cleaning apparatus including a suction nozzle; an air suction unit being in fluid communication with the suction nozzle via an entering passage; and at least two contaminant collecting receptacles being in fluid communication with at least two exits formed at the air suction unit, respectively.

According to another aspect of the present invention, a stick type cleaning apparatus may include a cleaner body; a stick handle disposed at the cleaner body; and a bypass type cleaning apparatus disposed at the cleaner body, the bypass type cleaning apparatus including a suction nozzle; an air suction unit being in fluid communication with the suction nozzle via an entering passage; and at least two contaminant collecting receptacles being in fluid communication with at least two exits formed at the air suction unit, respectively.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and/or other aspects and advantages of the invention will become apparent and more readily appreciated from the following description of the embodiments, taken in conjunction with the accompanying drawings of which.

DETAILED DESCRIPTION OF THE EXEMPLARY EMBODIMENTS

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
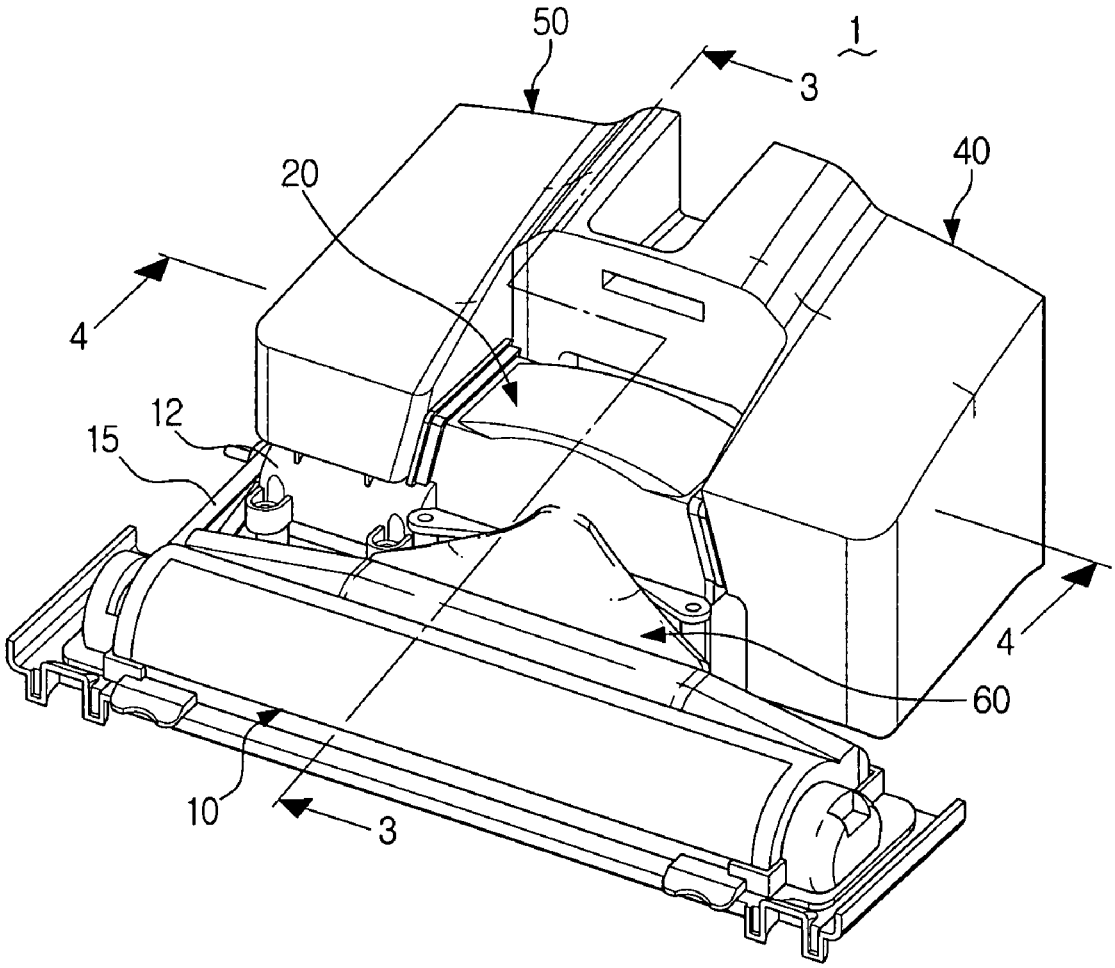
FIG. 1 is a perspective view illustrating a bypass type cleaning apparatus according to an exemplary embodiment of the present invention.
Figure 2:
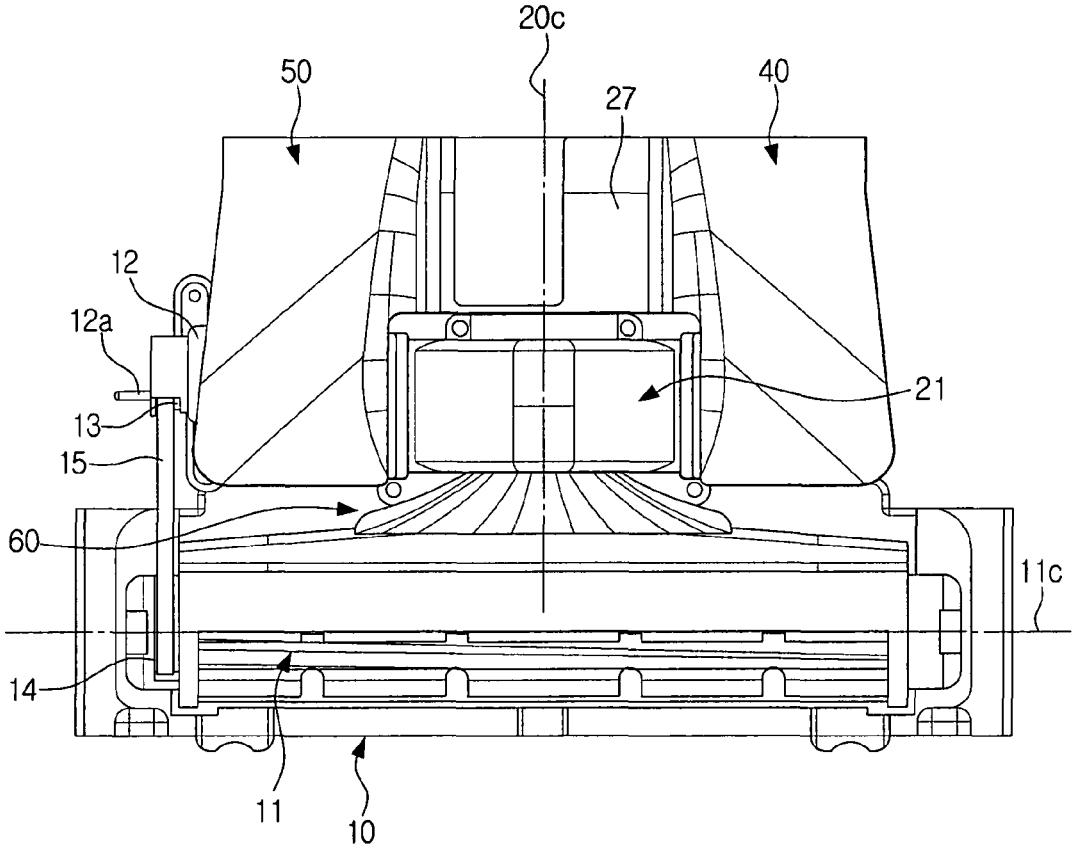
FIG. 2 is a bottom view illustrating the bypass type cleaning apparatus of FIG. 1.
Figure 3:
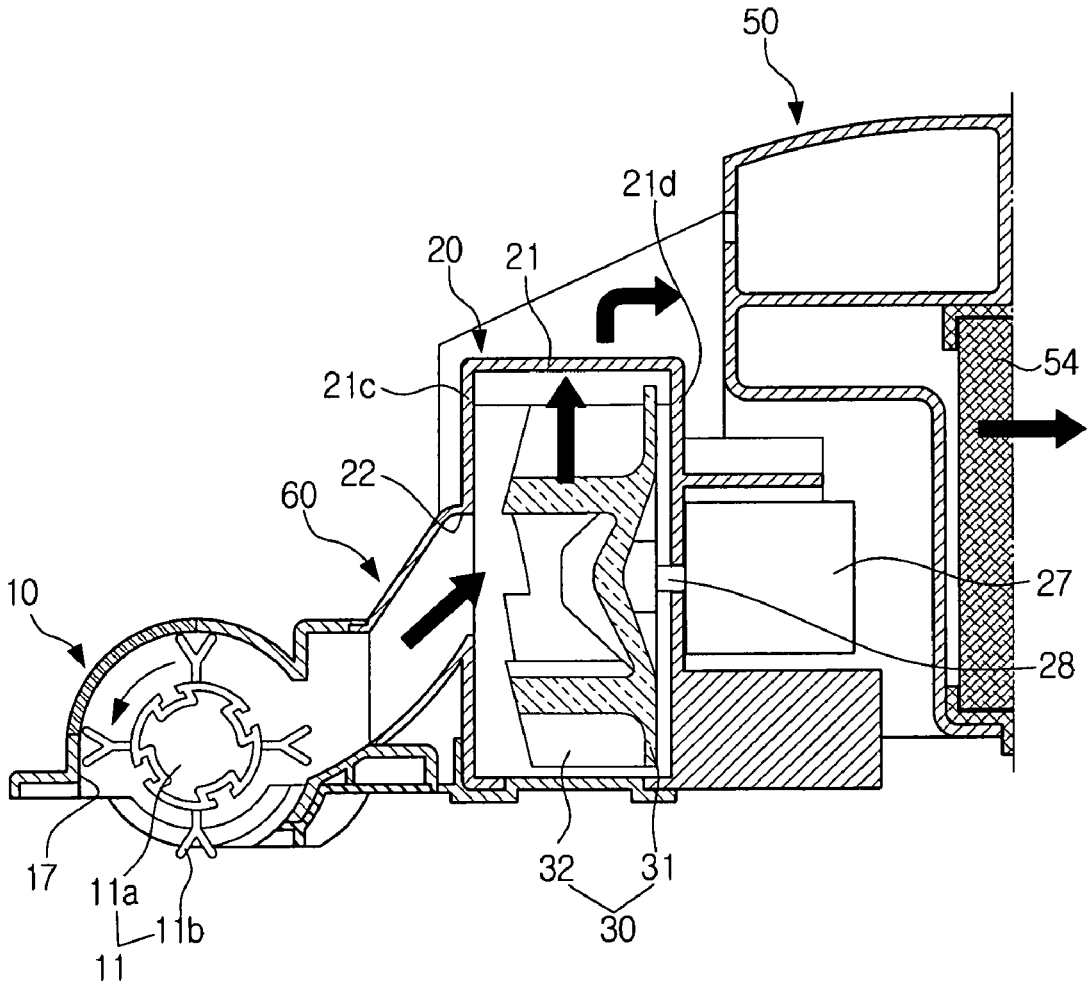
FIG. 3 is a sectional view illustrating the bypass type cleaning apparatus of FIG. 1 taken along a line 3-3 in FIG. 1.
Figure 4:
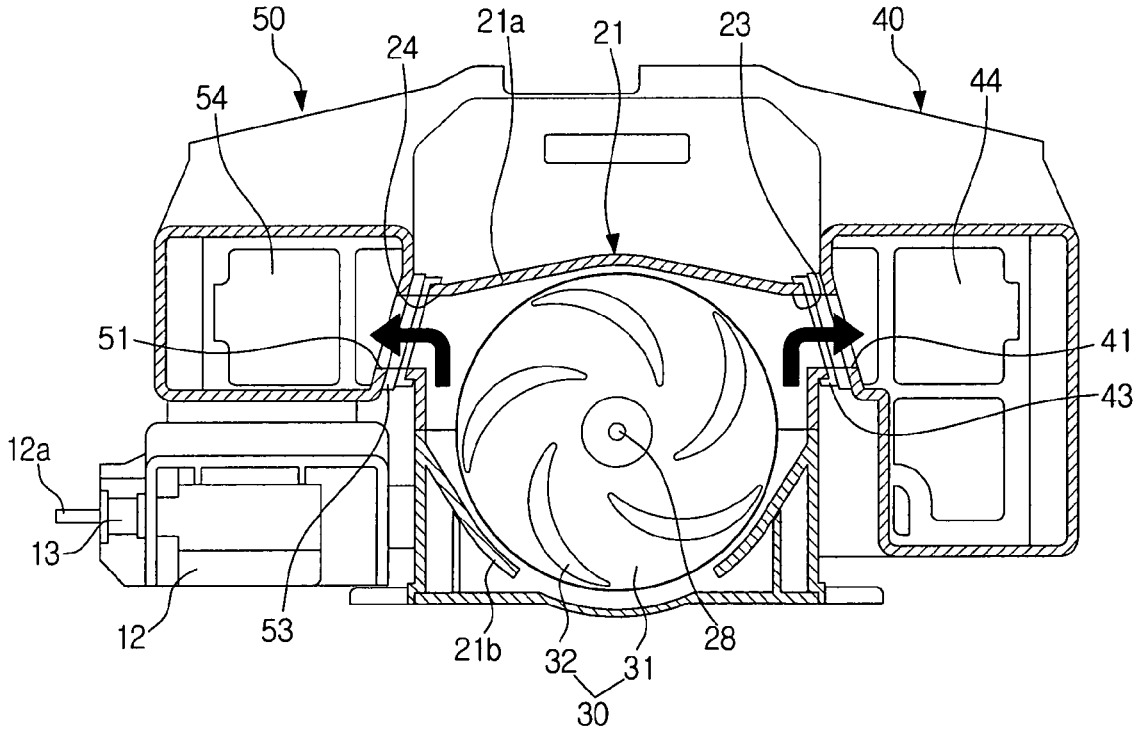
FIG. 4 is a sectional perspective view illustrating the bypass type cleaning apparatus of FIG. 1 taken along a line 4-4 in FIG. 1.

FIG. 1 is a perspective view illustrating a bypass type cleaning apparatus 1 according to an exemplary embodiment of the present invention. FIG. 2 is a bottom view illustrating the bypass type cleaning apparatus 1 of FIG. 1. FIG. 3 is a sectional view illustrating the bypass type cleaning apparatus 1 of FIG. 1 taken along a line 3-3 in FIG. 1. FIG. 4 is a sectional perspective view illustrating the bypass type cleaning apparatus 1 of FIG. 1 taken along a line 4-4 in FIG. 1.

Referring to FIGS. 1 to 4, the bypass type cleaning apparatus 1 according to an exemplary embodiment of the present invention includes a suction nozzle 10, an air suction unit 20, and first and second contaminant collecting receptacles 40 and 50.

The suction nozzle 10 draws in contaminants from a surface to be cleaned and includes a contaminant suction port 17 to face the surface to be cleaned. A rotating brush 11 is rotatably disposed in the contaminant suction port 17. The rotating brush 11 includes a rotating drum 11*a* and a plurality of brush hairs 11*b* disposed on a surface of the rotating drum 11*a*. Therefore, when the rotating brush 11 rotates, the brush hairs 11*b* contact the surface to be cleaned and sweep off contaminants from the surface to be cleaned, thereby raising the contaminants toward an entering passage 60.

The rotating brush 11 may be configured to receive a power from a brush motor 12 and to rotate. The brush motor 12 may be directly connected to the rotating brush 11 to rotate the rotating brush 11. However, in this exemplary embodiment, as illustrated in FIG. 2, a belt 15 is used to transmit the power of the brush motor 12 to the rotating brush 11. The brush motor 12 is disposed under the second contaminant collecting receptacle 50. A driving pulley 13 is disposed at a rotating shaft 12*a* of the brush motor 12. A driven pulley 14 is disposed at an end of the rotating drum 11*a* of the rotating brush 11. The belt 15 connects the driving pulley 13 with the driven pulley 14. As a result, when the brush motor 12 rotates, the rotating brush 11 receives the power via the belt 15, thereby rotating.

The air suction unit 20 is disposed apart from the suction nozzle 10 at a side of the suction nozzle 10 on the basis of a longitudinal direction of the suction nozzle 10. The air suction unit 20 may be disposed at a position corresponding to an approximate center of the suction nozzle 10 in the longitudinal direction of the suction nozzle 10. That is, the air suction unit 20, as illustrated in FIG. 2, is disposed at a side of the air suction unit 20 so that a center axis 20C of an impeller motor 27 of the air suction unit 20 is disposed substantially at a right angle to a rotating shaft 11C of the rotating brush 11. The air suction unit 20 is connected with the suction nozzle 10 by the entering passage 60. In this exemplary embodiment, the entering passage 60 is formed in a duct having an isosceles trapezoid shape. The entering passage 60 is inclined upwardly from the suction nozzle 10 to the air suction unit 20, and is connected to an entrance 22 formed at a center of the air suction unit 20.

The air suction unit 20 includes a housing 21, an impeller 30, and the impeller motor 27.

The housing 21 forms a space in which the impeller 30 rotates, and a moving passage through which contaminants and air drawn-in from the surface to be cleaned pass. Therefore, the housing 21 may be formed so that the impeller 30 can smoothly discharge contaminants and air drawn-in inside the housing 21 through the entrance 22 to first and second exits 23 and 24. In this exemplary embodiment, as illustrated in FIG. 4, a bottom surface 21*b* of the housing 21 is formed in a curved surface to wrap an approximate half of the impeller 30. A top surface 21*a* of the housing 21 is formed substantially in a plane having a center portion bent slightly corresponding to the impeller 30. The entrance 22 connecting with the entering passage 60 is formed at a center of a front surface 21*c* of the housing 21. Two exits 23 and 24, that is, the first and second exits forming two discharging passages are formed at opposite side surfaces of the housing 21. The first and second exits 23 and 24 may be formed symmetric with respect to the rotating shaft 28 of the impeller motor 27.

In this exemplary embodiment, the housing 21 has two exits 23 and 24. The housing 21 may have three and more exits at need. At this time, the two and more exits may be formed to be in fluid communication with two and more corresponding contaminant collecting receptacles, respectively.

The impeller 30 is rotated by the impeller motor 27 so that the impeller 30 generates a suction force capable of drawing in contaminants from the surface to be cleaned and discharges the contaminants and air drawn-in into the housing 21 to the contaminant collecting receptacles 40 and 50. The impeller 30 is disposed at an approximate center of the inside of the housing 21 and is rotated by the impeller motor 27 disposed outside a rear surface of the housing 21.

The impeller 30 includes a rotating plate 31 connected to the rotating shaft 28 of the impeller motor 27 and a plurality of blades 32 disposed on the rotating plate 31. The plurality of blades 32 is radially arranged on the rotating plate 31 by a predetermined interval. A number of the blades 32 may be varied as desired. Noise of the impeller 30, amount of air that the impeller 30 can draw-in, etc. are changed according to the number of the blades 32. As a result, the impeller 30 may have four to six blades 32. Also, the blades 32 of the impeller 30 may be formed in various shapes.

Figure 5:
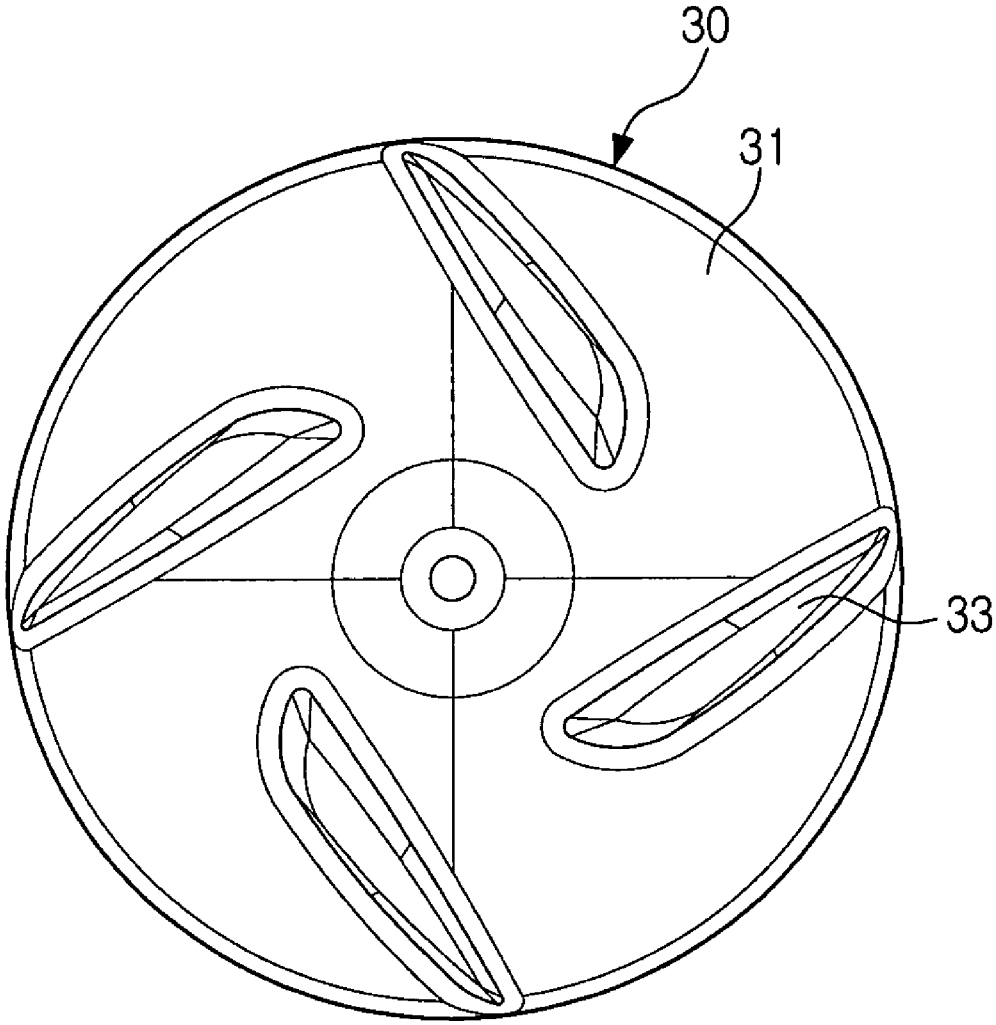
FIG. 5 is a front view illustrating a first example of an impeller of the bypass type cleaning apparatus of FIG. 1.
Figure 6:
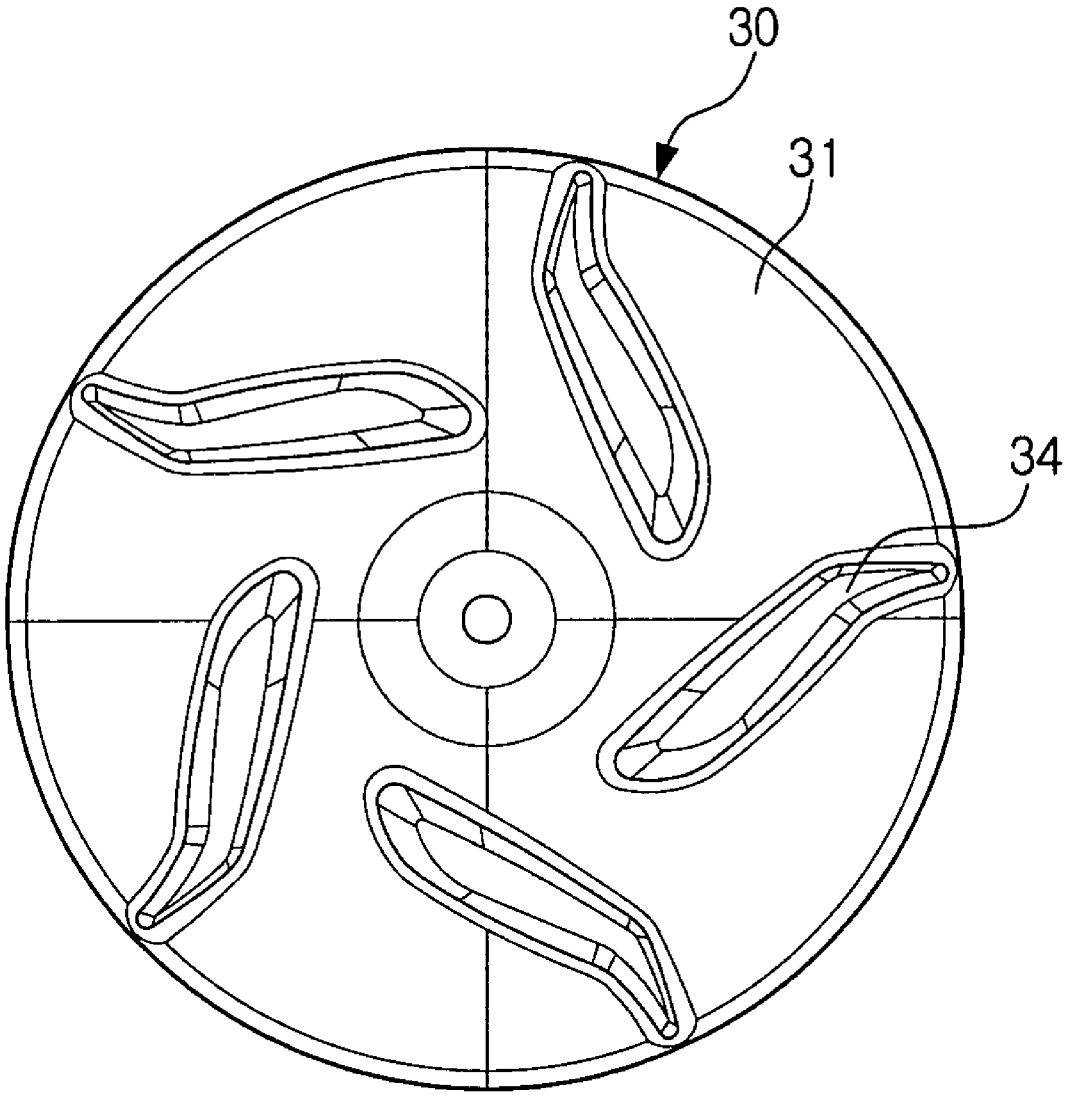
FIG. 6 is a front view illustrating a second example of an impeller of the bypass type cleaning apparatus of FIG. 1.
Figure 7:
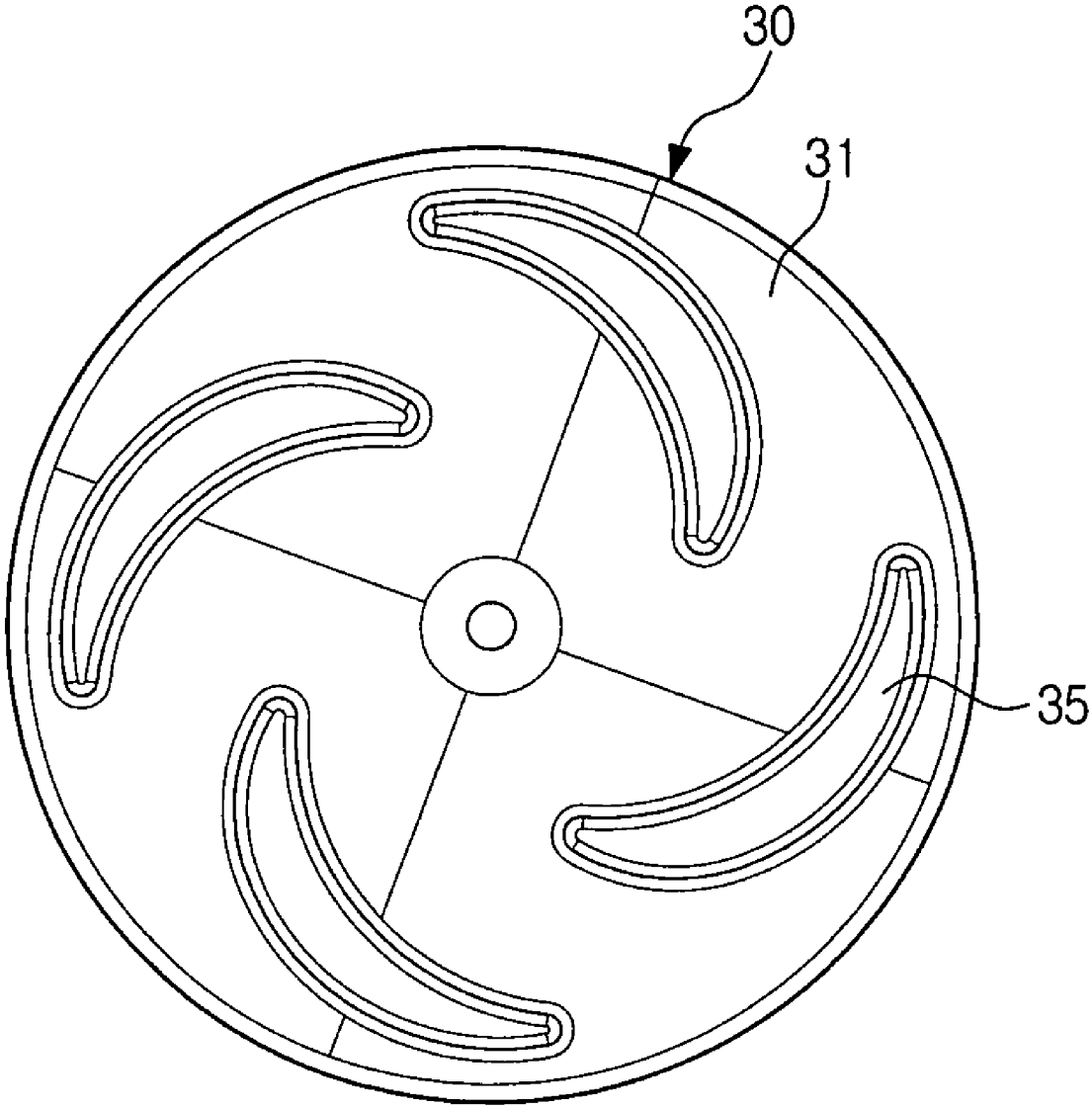
FIG. 7 is a front view illustrating a third example of an impeller of the bypass type cleaning apparatus of FIG. 1.

FIGS. 5 to 7 illustrate examples of the blades 32 usable with the impeller 30 of the bypass type cleaning apparatus 1 according to an exemplary embodiment of the present invention.

FIG. 5 illustrates the impeller 30 having a first example of the blade 33. The first example of the blade 33 is formed in an airfoil having a shape similar to an airplane wing. The impeller 30 having the airfoil blades 33 has wide intervals between the blades 33 so that an efficiency with which the impeller 30 separates contaminants is good.

FIG. 6 illustrates the impeller 30 having a second example of the blade 34. The second example of the blade 34 is formed in a flipped end shape. The blade 34 having the flipped end shape is formed substantially in an airfoil blade 33 an end of which is bent upwardly. The impeller 30 having the flipped end shaped blades 34 can draw in an amount of air more than the impeller 30 having the airfoil blades 33 or circular tip shaped blades 35 when rotating in the same speed.

FIG. 7 illustrates the impeller 30 having a third example of the blade 35. The third example of the blade 35 is formed in a circular tip shape. The circular tip shaped blade 35 is formed in a shape similar to a crescent moon. The circular tip shaped blade 35 may be formed to bend the airfoil blade 33 in a predetermined curvature. The impeller 30 having the circular tip shaped blades 35 generates noise lower than the impeller 30 having the airfoil blades 33 or the flipped end shaped blades 34 when rotating in the same speed.

The impeller motor 27 is disposed outside the housing 2l, that is, at the rear surface 21 d of the housing 21. The rotating shaft 28 of the impeller motor 27 projects inside the housing 21. The impeller 27 is disposed at the end of the rotating shaft 28 of the impeller motor 27. As a result, when the impeller motor 27 rotates, the impeller 30 rotates, thereby generating a suction force. The suction force draws in contaminants and air from a surface to be cleaned into the housing 21. Because the impeller motor 27 is disposed at the rear surface 21*d* of the housing 21, the contaminants and air drawn-in by the impeller 30 do not pass through the impeller motor 27. That is, the contaminants and air drawn-in by the impeller 30 bypass or contour the impeller motor 27, and then, are collected into the first and second contaminant collecting receptacles 40 and 50.

The first and second contaminant collecting receptacles 40 and 50 are disposed at both sides of the air suction unit 20, and collect contaminants discharged from the housing 21 of the air suction unit 20. At this time, the first and second contaminant collecting receptacles 40 and 50 may be disposed symmetric with respect to the air suction unit 20. Also, the first and second contaminant collecting receptacles 40 and 50 may be formed to wrap a rear side of the impeller motor 27 of the air suction unit 20. Therefore, the air suction unit 20 locates at an approximate center of the first and second contaminant collecting receptacles 40 and 50. The first and second contaminant collecting receptacles 40 and 50 may be formed so that they are spaced apart from the suction nozzle 10 and do not locate directly above the suction nozzle 10.

The brush motor 12 may be disposed underneath one of the first and second contaminant collecting receptacles 40 and 50. In this exemplary embodiment, the brush motor 12 is disposed underneath the second contaminant collecting receptacle 50.

The first contaminant collecting receptacle 40 includes a first contaminant inlet 41 in fluid communication with the first exit 23 of the housing 21, and the second contaminant collecting receptacle 50 includes a second contaminant inlet 51 in fluid communication with the second exit 24 of the housing 21. The first exit 23 of the housing 21 is connected with the first contaminant inlet 41 of the first contaminant collecting receptacle 40. A first sealing member 43 is disposed between the first exit 23 and the first contaminant inlet 41. Therefore, the first exit 23 of the housing 21 and the first contaminant inlet 41 of the first contaminant collecting receptacle 40 form a first discharging passage through which contaminants and air discharged from the housing 21 pass. Also, the second exit 24 of the housing 21 is connected with the second contaminant inlet 51 of the second contaminant collecting receptacle 50. A second sealing member 53 is disposed between the second exit 24 and the second contaminant inlet 51. Therefore, the second exit 24 of the housing 21 and the second contaminant inlet 51 of the second contaminant collecting receptacle 50 form a second discharging passage through which contaminants and air discharged from the housing 21 pass.

The contaminants discharged from the first and second exits 23 and 24 of the housing 21 fall by their own weight and accumulate inside each of the first and second contaminant collecting receptacles 40 and 50. Each of first and second filters 44 and 54 is disposed at a rear side of each of the first and second contaminant collecting receptacles 40 and 50. Therefore, air discharged with contaminants from the first and second exit 23 and 24 of the housing 21 is exhausted outside through the first and second filters 44 and 54, respectively. The first and second filters 44 and 54 separate fine contaminants, which do not fall by their own weight and move with the air, from the air.

Although not illustrated, the bypass type cleaning apparatus 1 according to an exemplary embodiment of the present invention includes an electric power portion supplying electric power to the brush motor 12 and the impeller motor 27, and a controller controlling the brush motor 12 and the impeller motor 27. The electric power portion may use a battery (not illustrated) mounted to the bypass type cleaning apparatus or a commercial electric power source disposed separately from the bypass type cleaning apparatus 1. When using the commercial electric power source, the bypass type cleaning apparatus 1 has a power cord (not illustrated) capable of connecting to the commercial electric power source. The controller is similar to a controller of the conventional vacuum cleaner; therefore, a detailed description thereof will be omitted.

Hereinafter, operation of the bypass type cleaning apparatus 1 according to an exemplary embodiment of the present invention in detail with reference to FIGS. 1 to 4.

When electric power is applied to the brush motor 12 and the impeller motor 27, the rotating brush 11 and the impeller 30 rotate. When the rotating brush 11 rotates, the brush hairs 11*b* of the rotating brush 11 contacting the surface to be cleaned separate contaminants from the surface to be cleaned and raise the contaminants to the entering passage 60.

When the impeller 30 rotates, the contaminants separated from the surface to be cleaned by the rotating brush 11 enter the entrance 22 of the housing 21 via the entering passage 60 with air. The air and contaminants entering inside the housing 21 via the entrance 22 thereof are discharged through the first and second exits 23 and 24 of the housing 21 by centrifugal force generated by the rotating of the impeller 30. At this time, some contaminants collide with the plurality of blades 32 of the impeller 30, and are discharged through the first and second exits 23 and 24 of the housing 21 by impact force therebetween. If the housing 21 has only one exit, the contaminants and air being discharged from the housing 21 are concentrated on the exit, thereby generating loud noise. However, in the bypass type cleaning apparatus 1 according to an exemplary embodiment of the present invention, the housing 21 has two exits 23 and 24 so that the contaminants and air are divided and discharged through the two exits 23 and 24. As a result, noise may be reduced compared to the housing having one exit.

The contaminants and air discharged from the first exit 23 enter the first contaminant collecting receptacle 40 through the first contaminant inlet 41. The contaminants entering the first contaminant collecting receptacle 40 fall by their own weight and accumulate on a bottom surface of the first contaminant collecting receptacle 40. The air is discharged outside via the first filter 44 of the first contaminant collecting receptacle 40. The contaminants and air discharged from the second exit 24 enter the second contaminant collecting receptacle 50 through the second contaminant inlet 51. Just as the contaminants and air entering the first contaminant collecting receptacle 40, the contaminants entering the second contaminant collecting receptacle 50 fall by their own weight and accumulate on a bottom surface of the second contaminant collecting receptacle 50, and the air is discharged outside via the second filter 54 of the second contaminant collecting receptacle 50.

As described above, in the bypass type cleaning apparatus 1 according to an exemplary embodiment of the present invention, drawn-in contaminants and air do not pass through the impeller motor 27, but they pass through the housing 21 in which the impeller 30 is disposed and are discharged to the first and second contaminant collecting receptacles 40 and 50. Also, because suction force generated by the impeller motor 27 directly operates on contaminants on the surface to be cleaned, even when a motor having a capacity smaller than that of the suction motor of the conventional vacuum cleaner is used as the impeller motor 27, the cleaning apparatus 1 according to the present invention can effectively draw in contaminants.

The bypass type cleaning apparatus 1 according to an exemplary embodiment of the present invention uses a motor having a smaller capacity than that of the suction motor of the conventional vacuum cleaner. Therefore, electrical power consumption thereof is lower than that of the conventional vacuum cleaner. As a result, the bypass type cleaning apparatus 1 according to the present invention can be used in cleaning apparatuses using a battery to operate the motor, such as a stick type cleaning apparatus, a robot cleaner, etc.

Figure 8:
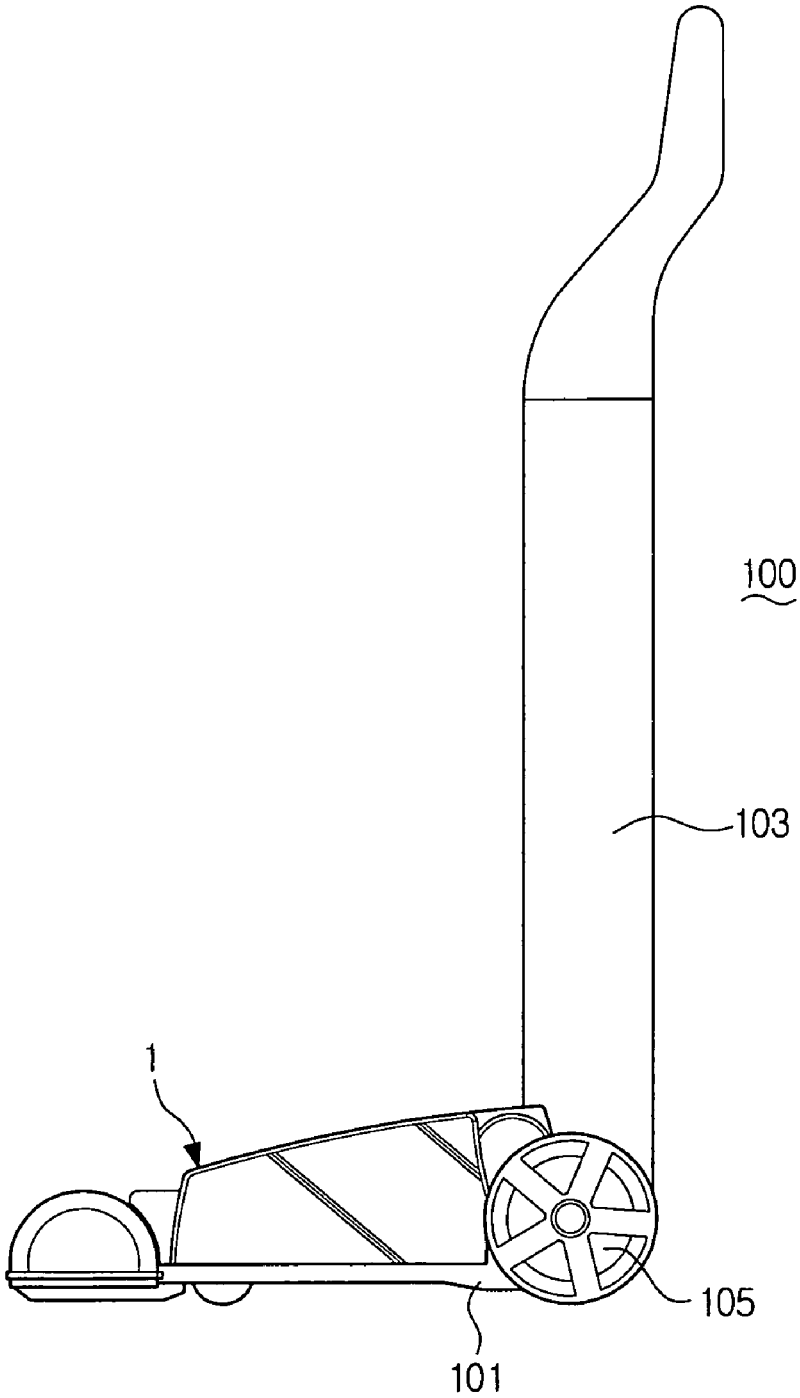
FIG. 8 is a side view illustrating a stick type cleaning apparatus using a bypass type cleaning apparatus according to an exemplary embodiment of the present invention.
Figure 9:
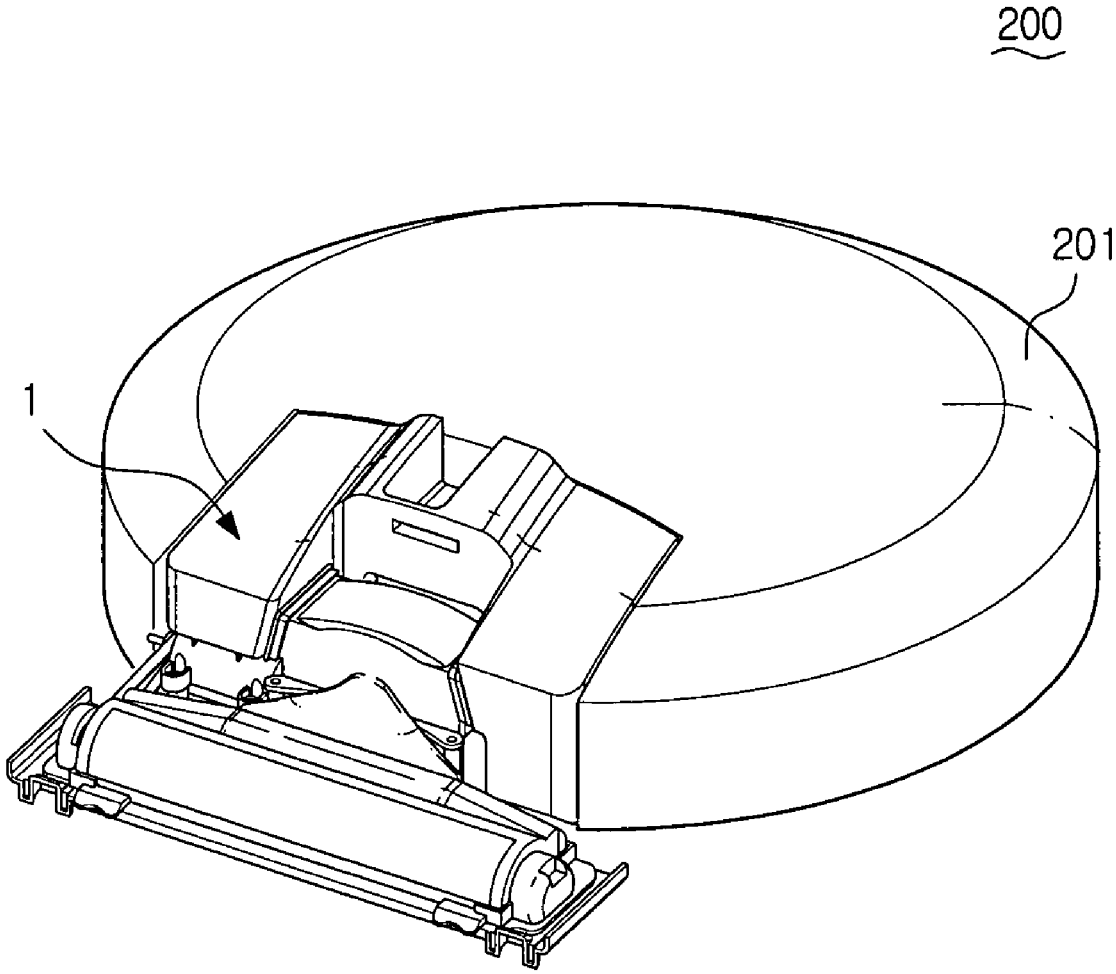
FIG. 9 is a side view illustrating a robot cleaner using a bypass type cleaning apparatus according to an exemplary embodiment of the present invention Throughout the drawings, like reference numerals will be understood to refer to like parts, components and structures.

FIG. 8 is a side view illustrating a stick type cleaning apparatus 100 using the bypass type cleaning apparatus 1 according to an exemplary embodiment of the present invention, and FIG. 9 is a side view illustrating a robot cleaner 200 using the bypass type cleaning apparatus 1 according to an exemplary embodiment of the present invention.

Referring to FIG. 8, the stick type cleaning apparatus 100 includes a cleaner body 101 in which the bypass type cleaning apparatus 1 according to an exemplary embodiment of the present invention is disposed, and a stick handle 103 for controlling the cleaner body 101. A pair of wheels 105 is disposed at both sides of the cleaner body 101, thereby allowing the cleaner body 101 to move smoothly. Therefore, a user holds the stick handle 103, and moves the cleaner body 101 in which the bypass type cleaning apparatus 1 according to an exemplary embodiment of the present invention is disposed to clean.

Referring to FIG. 9, the robot cleaner 200 has a robot body 201 in which the bypass type cleaning apparatus 1 according to an exemplary embodiment of the present invention is disposed. The robot body 201 includes a driving portion (not illustrated) allowing the robot cleaner 200 to move, a robot controller (not illustrated) controlling the robot cleaner 200 to recognize (or perceive) autonomously a position of it and to perform a cleaning task, and a battery (not illustrated). The battery supplies electric power to the bypass type cleaning apparatus 1, the driving portion, and the robot controller. Therefore, the robot cleaner 200 can autonomously move and perform a cleaning task using the bypass type cleaning apparatus 1 according to an exemplary embodiment of the present invention.

With the bypass type cleaning apparatus according to an exemplary embodiment of the present invention, a suction force generated by the impeller of the air suction unit directly operates on a surface to be cleaned to draw in contaminants so that a motor having a smaller capacity than that of the suction motor of the conventional vacuum cleaner can be used. Therefore, the bypass type cleaning apparatus according to an exemplary embodiment of the present invention can reduce electrical power consumption thereof.

Since the bypass type cleaning apparatus according to an exemplary embodiment of the present invention is configured so that the air suction unit directly draws in contaminants from a surface to be cleaned, even when a motor having a capacity smaller than that of the suction motor of the conventional vacuum cleaner is used, the bypass type cleaning apparatus according to the present invention does not have a contaminant suction efficiency lower than the conventional vacuum cleaner.

Also, since the bypass type cleaning apparatus according to an exemplary embodiment of the present invention is configured so that the air suction unit has at least two exits, contaminants and air discharged from the air suction unit are prevented from concentrating on one exit. Therefore, when cleaning, noise can be reduced.

While the exemplary embodiments of the present invention have been described, additional variations and modifications of the exemplary embodiments may occur to those skilled in the art once they learn of the basic inventive concepts. Therefore, it is intended that the appended claims shall be construed to include both the above exemplary embodiments and all such variations and modifications that fall within the spirit and scope of the invention.

What is claimed is:

1. A bypass type cleaning apparatus comprising:

a suction nozzle, the suction nozzle including a rotating brush rotatably disposed at a contaminant suction port of the suction nozzle;

an air suction unit being in fluid communication with the suction nozzle via an entering passage; and at least two contaminant collecting receptacles being in fluid communication with at least two exits formed at the air suction unit, respectively.

2. The bypass type cleaning apparatus of claim 1, wherein the entering passage is disposed at a center of the air suction unit.

3. The bypass type cleaning apparatus of claim 1, wherein the at least two contaminant collecting receptacles are arranged to be symmetric with each other at both sides of the air suction unit.

4. The bypass type cleaning apparatus of claim 1, wherein the air suction unit includes:

a housing connected with the entering passage, and having the at least two exits;

an impeller disposed inside the housing; and an impeller motor disposed outside the housing, and causing the impeller to rotate.

5. The bypass type cleaning apparatus of claim 1, wherein the rotating brush is caused to rotate by a brush motor disposed underneath one of the at least two contaminant collecting receptacles.

6. The bypass type cleaning apparatus of claim 1, wherein each of the at least two contaminant collecting receptacles includes a filter.

7. The bypass type cleaning apparatus of claim 4, wherein the impeller includes:

a rotating plate connected to a rotating shaft of the impeller motor; and a plurality of blades disposed on the rotating plate.

8. The bypass type cleaning apparatus of claim 7, wherein the plurality of blades comprises 4 to 6 blades.

9. The bypass type cleaning apparatus of claim 7, wherein each of the plurality of blades is formed in a shape selected from a group of an airfoil, a flipped end shape, and a circular tip shape.

10. A bypass type cleaning apparatus comprising:

a suction nozzle;

an air suction unit disposed at one side of the suction nozzle, and being in communication with the suction nozzle via an entering passage, the air suction unit including:

a housing having an entrance connected with the entering passage, and first and second exits connected with each of the first and second contaminant collecting receptacles, an impeller disposed inside the housing, and an impeller motor disposed outside the housing, and causing the impeller to rotate; and first and second contaminant collecting receptacles disposed at both sides of the air suction unit, and being in fluid communication with the air suction unit.

11. The bypass type cleaning apparatus of claim 10, wherein the entrance of the housing is formed at a center of a front surface of the housing.

12. The bypass type cleaning apparatus of claim 10, wherein the first and second exits of the housing are formed at both side surfaces of the housing.

13. The bypass type cleaning apparatus of claim 10, wherein the suction nozzle includes a rotating brush rotatably disposed at a contaminant suction port of the suction nozzle.

14. The bypass type cleaning apparatus of claim 13, wherein the routing brush is configured to rotate by a brush motor disposed underneath one of the first and second contaminant collecting receptacles.

15. The bypass type cleaning apparatus of claim 10, wherein the impeller includes;

a rotating plate connected to a rotating shaft of the impeller motor; and a plurality of blades disposed on the rotating plate.

16. The bypass type cleaning apparatus of claim 15, wherein each of the plurality of blades is formed in a shape selected from a group of an airfoil, a flipped end shape, and a circular tip shape.

* * * * *